US006892611B2

(12) United States Patent
Sasaki

(10) Patent No.: US 6,892,611 B2
(45) Date of Patent: May 17, 2005

(54) SCREWDRIVER

(75) Inventor: Katsuhiko Sasaki, Anjio (JP)

(73) Assignee: Makita Corporation, Anjo (JP)

( * ) Notice: Subject to any disclaimer, the term of this patent is extended or adjusted under 35 U.S.C. 154(b) by 0 days.

(21) Appl. No.: 10/600,934

(22) Filed: Jun. 20, 2003

(65) Prior Publication Data

US 2004/0055432 A1 Mar. 25, 2004

(30) Foreign Application Priority Data

Jun. 21, 2002 (JP) ..... 2002-182003

(51) Int. Cl.[7] ..... B25B 23/157
(52) U.S. Cl. ..... 81/467; 81/473
(58) Field of Search ..... 81/467, 472–477

(56) References Cited

U.S. PATENT DOCUMENTS

| | | | | | |
|---|---|---|---|---|---|
| 2,468,193 | A | * | 4/1949 | Goff | 464/40 |
| 2,827,779 | A | * | 3/1958 | Holloway | 81/474 |
| 4,631,992 | A | * | 12/1986 | Eckman | 81/470 |
| 4,774,864 | A | * | 10/1988 | Dossier | 81/474 |
| 5,735,183 | A | * | 4/1998 | Sasaki et al. | 81/473 |
| 6,668,690 | B2 | * | 12/2003 | Kikuchi et al. | 81/473 |

FOREIGN PATENT DOCUMENTS

| | | |
|---|---|---|
| JP | 61-219581 | 9/1986 |
| JP | 2003-220568 | 8/2003 |
| JP | 2003-266325 | 9/2003 |

* cited by examiner

*Primary Examiner*—David B. Thomas
(74) *Attorney, Agent, or Firm*—Lahive & Cockfield, LLP; Anthony A. Laurentano, Esq.

(57) ABSTRACT

It is an object of the invention to provide an electric screwdriver that can efficiently transmit torque for tightening a screw and stop the torque transmission. A representative screwdriver may include a motor, first and second rotating members, a tool, a torque transmission spring and a torque transmission releasing device. The torque transmission spring transmits the rotating torque of the motor from the first rotating member to the second rotating member in order to drive the tool by closely winding around the first rotating member and the second rotating member when the motor drivingly rotates the first rotating member in a predetermined rotating direction. Further, the torque transmission releasing device moves in the axial direction of the first rotating member or the second rotating member in response to the screw-tightening torque. By such movement, the torque transmission releasing device releases the close winding of the torque transmission spring around at least one of the first rotating member and the second rotating member and releases the transmission of the rotating torque of the motor to the tool.

15 Claims, 2 Drawing Sheets

SCREWDRIVER

BACKGROUND OF THE INVENTION

The teachings of U.S. patent application Ser. No. 10/353,672, filed on Jan. 29, 2003, are herein incorporated by reference.

1. Field of the Invention

The invention relates to an electric screwdriver that can efficiently transmit torque for screw-tightening operation and release the torque transmission.

2. Description of the Related Art

An electric screwdriver is disclosed in unexamined Japanese laid-open patent publication No. 61-219581. The known screwdriver includes a silent clutch mechanism to connect a tool to a motor for transmitting the rotating torque of the motor to the tool. The silent clutch includes clutch members with clutch teeth that can be engaged with each other to transmit the motor torque to the tool. By utilizing the silent clutch mechanism, when the screw is tightened to a predetermined depth with respect to the workpiece, the clutch members can be promptly disengaged to stop transmission of the rotating torque of the driving motor. As a result, noise and vibration during screw-tightening operation can be avoided.

In the known screwdriver, the silent clutch mechanism is disposed between a rotating member on the motor side and a rotating member on the tool side. In order to transmit the rotating torque of the motor to the tool, user of the screwdriver applies a pressing load on the screwdriver while keeping the tool in abutment on the workpiece. At this time, the tool side rotating member moves toward the motor side rotating member and engages it. As a result, the motor torque is transmitted to the tool via the both rotating members which have been engaged with each other.

In the above-mentioned known technique, in order to transmit the motor torque to the tool, the user must apply a pressing load on the screwdriver to keep torque transmission from the motor to the tool via the mutually engaged rotating members. Otherwise, the torque transmission is cancelled when the pressing load of the user is not applied onto the screwdriver. However, as for a screw such as a universal joint, which is tightened in a relatively narrow work area, the user of the known screwdriver may be in difficulty to continuously apply a pressing load onto the screwdriver during the screw tightening operation.

SUMMARY OF THE INVENTION

It is, accordingly, an object of the present invention to provide an electric screwdriver that can efficiently transmit torque for tightening a screw and stop the torque transmission.

According to the present invention, a representative screwdriver may include a motor, first and second rotating members, a tool, a torque transmission spring and a torque transmission releasing device. The torque transmission spring transmits the rotating torque of the motor from the first rotating member to the second rotating member in order to drive the tool by closely winding around the first rotating member and the second rotating member when the motor drivingly rotates the first rotating member in a predetermined rotating direction. Further, the torque transmission releasing device moves in the axial direction of the first rotating member or the second rotating member in response to the screw-tightening torque. By such movement, the torque transmission releasing device releases the close winding of the torque transmission spring around at least one of the first rotating member and the second rotating member and releases the transmission of the rotating torque of the motor to the tool.

According to the present invention, the rotating torque of the motor can be transmitted by means of the torque transmission spring that closely wound around the rotating members and therefore the motor torque can be transmitted without any pressing load of the user to the screwdriver. Further, the torque transmission releasing device can immediately cancel the torque transmission in response to the screw-tightening torque. Thus, the respective screwdriver can efficiently transmit torque for tightening a screw and stop the torque transmission.

Other objects, features and advantages of the present invention will be readily understood after reading the following detailed description together with the accompanying drawings and the claims.

DETAILED DESCRIPTION OF THE REPRESENTATIVE EMBODIMENT

Figure 1:
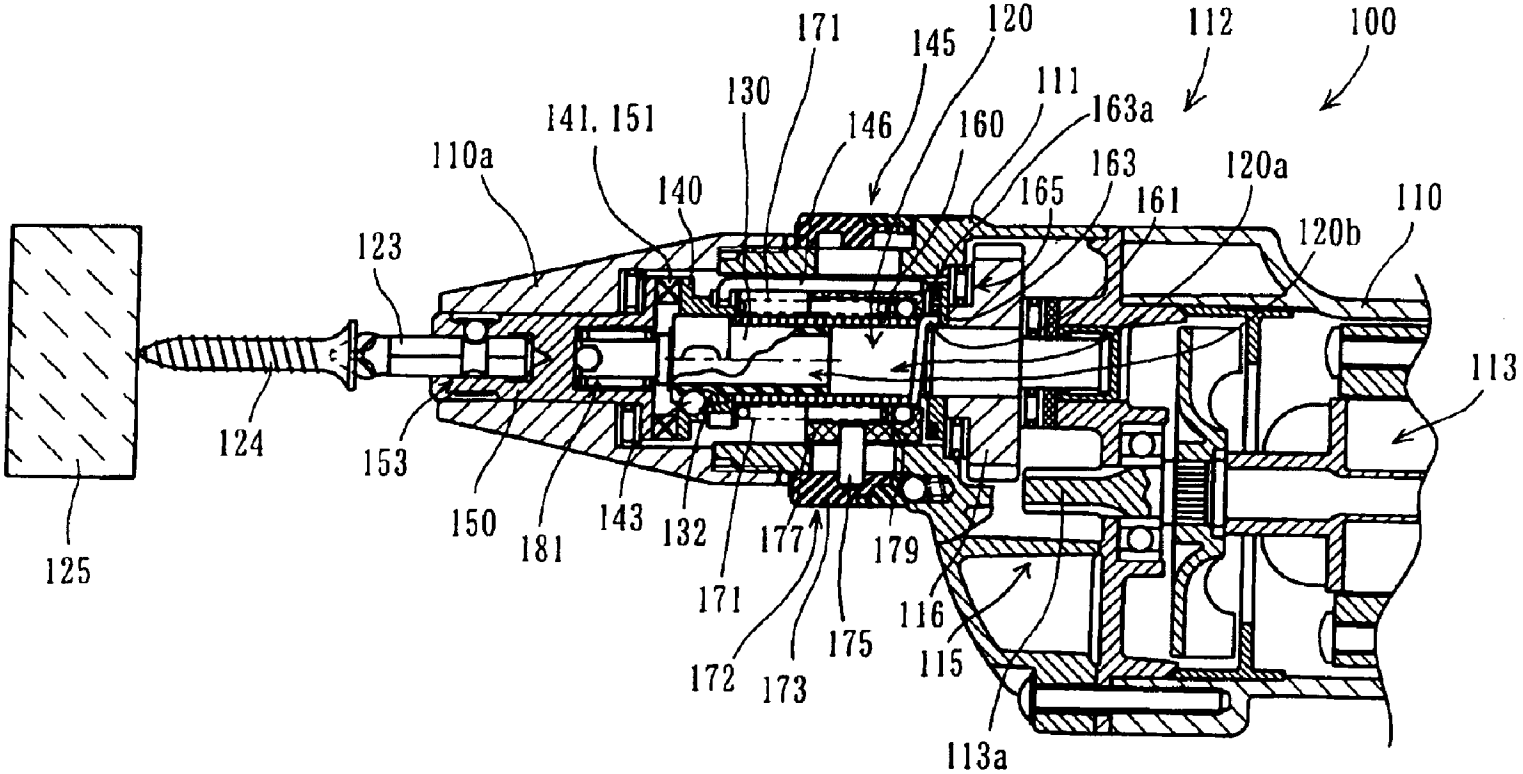
FIG. 1 shows essential part of an electric screwdriver according to the representative embodiment of the invention.

According to the present teachings, a representative electric screwdriver may include a motor, a first rotating member, a second rotating member and a tool. The first rotating member is driven by the motor. An AC motor, a DC brushless motor or other various motors may be utilized as a motor. Preferably, the first rotating member may be connected to the motor via a speed reducing mechanism that utilizes for example planetary gears and so on. The second rotating member is adapted to rotate by receiving the rotating torque of the first rotating member.

The tool is drivingly rotated via the first rotating member and the second rotating member for screw-tightening operation. According to the present teachings, a torque transmission spring is used to transmit the rotating torque of the motor from the first rotating member to the second rotating member. The torque transmission spring closely winds around the first rotating member and the second rotating member when the motor is driven to rotate the first rotating member in a predetermined direction. Thus, the motor torque is transmitted from the first rotating member to the second rotating member. A driver bit typically corresponds to the "tool" according to the present invention. As the "torque transmission spring", for example, a square ring can be suitably utilized.

Further, in the present teachings, a torque transmission releasing device is provided to prevent the torque transmission spring from transmitting the motor torque. The torque transmission releasing device moves in the axial direction of the first rotating member or the second rotating member in response to the screw-tightening torque. Thus, the torque transmission releasing device releases the close winding of the torque transmission spring around at least one of the first rotating member and the second rotating member. As a result, transmission of the rotating torque of the motor from the first rotating member to the second rotating member is released. Preferably, the torque transmission releasing device may swiftly and assuredly release the transmission of the motor torque according to the screw-tightening torque. With such construction, effectiveness as a silent clutch can be ensured.

The torque transmission releasing device may be configured and arranged to release the close winding of the torque transmission spring around the first rotating member or the second rotating member or the both members. In order to release such close winding, for example, the end of the torque transmission spring may be locked. As a result, the torque transmission spring is allowed to rotate relative to the rotating member, so that it can no longer be closely wound around the rotating member. Or the torque transmission spring may be rotated relative to the rotating member in a direction opposite to the winding direction of the torque transmission spring around the rotating member, so that the close winding around the rotating member can be positively released. With respect to the movement "in response to the screw-tightening torque", for example, when the operation of tightening screws on the workpiece is nearly completed and the screw-tightening torque exceeds a predetermined torque, the torque transmission may be released.

In the screwdriver according to the present teachings, driving torque of the motor is transmitted from the first rotating member to the second rotating member via the torque transmission spring. Further, the torque transmission releasing device is adapted to appropriately release and cancel such transmission of the motor torque in response to the screw-tightening torque. Therefore, user of the screwdriver does not have to apply a pressing load on the screwdriver as in the known technique in order to engage the rotating members with each other. Thus, the screw-tightening operation can be performed efficiently.

Preferably, the torque transmission releasing device may engage the torque transmission spring so as to prevent the torque transmission spring from being closely wound in the rotational direction of the first rotating member, so that the torque transmission releasing device releases the close winding of the torque transmission spring around the first rotating member. Transmission of the motor torque and its release can be easily controlled by releasing the close winding of the torque transmission spring around the first rotating member. Preferably, in order to engage the torque transmission spring, the end of the torque transmission spring may be typically engaged such that it cannot move in the rotational direction of the first rotating member.

Preferably, the screwdriver may include a third rotating member that is disposed adjacent to the second rotating member and in the vicinity of the tool. The second rotating member may be connected to the third rotating member via a clutch member. Further, the clutch member may be adapted to move toward the first rotating member in the axial direction in response to the screw-tightening torque. The close winding of the torque transmission spring around the first rotating member may be performed or released in response to the axial movement of the clutch member. Specifically, the clutch member is disposed between the second rotating member and the third rotating member and moves toward the first rotating member in the axial direction in response to the screw-tightening torque so that the close winding of the torque transmission spring around the first rotating member is performed or released. By providing such clutch member that moves in the axial direction so as to control the close winding of the torque transmission spring, the screwdriver can be downsized in its structure.

Preferably, the clutch member may include an engagement member that extends toward the first rotating member. The clutch member may be urged toward the third rotating member by a spring. Preferably, the clutch member may be adapted to move toward the first rotating member against the biasing force of the spring when the screw-tightening torque exceeds a predetermined torque. When the clutch member moves toward the first rotating member, the engagement member engages the torque transmission spring so as to release the close winding of the torque transmission spring around the first rotating member. The clutch member is adapted to move by or against the biasing force of the spring, so that the close winding of the torque transmission spring and its release via the clutch member can be reliably controlled.

Further, preferably, the screwdriver may be configured to transmit the rotating torque of the motor to the tool via a first torque transmission path and a second torque transmission path. Through the first torque transmission path, the rotating torque of the motor is transmitted from the first rotating member to the tool via the torque transmission spring and the second rotating member. When the motor is rotated in a reverse direction so that the torque transmission by the torque transmission spring is released, the torque of the motor rotating in the reverse direction is transmitted from the first rotating member to the tool via a one-way clutch through the second torque transmission path. Specifically, when the motor is rotated in a forward direction, as mentioned above, the rotating torque of the motor is transmitted from the first rotating member to the second rotating member by utilizing the torque transmission spring. On the other hand, when the motor is rotated in a reverse direction, the torque transmission by the torque transmission spring is released. In this state, the motor torque is transmitted from the first rotating member to the tool by utilizing a one-way clutch. With such construction, motor torque can be efficiently transmitted during rotation of the motor in the reverse direction as well as in the forward direction.

Each of the additional features and method steps disclosed above and below may be utilized separately or in conjunction with other features and method steps to provide improved screwdrivers and method for using such screwdriver and devices utilized therein. Representative examples of the present invention, which examples utilized many of these additional features and method steps in conjunction, will now be described in detail with reference to the drawings. This detailed description is merely intended to teach a person skilled in the art further details for practicing preferred aspects of the present teachings and is not intended to limit the scope of the invention. Only the claims define the scope of the claimed invention. Therefore, combinations of features and steps disclosed within the following detailed description may not be necessary to practice the invention in the broadest sense, and are instead taught merely to particularly describe some representative examples of the invention, which detailed description will now be given with reference to the accompanying drawings.

FIG. 1 shows a representative electric screwdriver 100 according to the present teachings. In FIG. 1, however, only an essential part of the body 112 of the screwdriver 100 is shown such as a motor housing 110, a gear housing 111 and a sleeve 110*a* that is connected to the gear housing 111. To the contrary, a grip portion that is connected to the body 112 is not particularly shown in the drawings.

The screwdriver 100 includes a motor 113, a first spindle 120, a second spindle 130, a third spindle 150, a tool bit 123, a clutch cam 140, a square spring 160, a torque transmission releasing device 145, a spring 171 and a spring biasing force adjustment device 172. These components are disposed within the body 112.

The first spindle 120 is a feature that corresponds to a "first rotating member" according to the present invention, the tool bit 123 to a "tool", the second spindle 130 to a "second rotating member", the clutch cam 140 to a "clutch member", the third spindle 150 to a "third rotating member" and the square spring 160 to a "torque transmission spring", respectively.

An output shaft 113*a* of the motor 113 is connected to the first spindle 120 via a speed reducing mechanism 115 which include a reduction gear 116. However, for the sake of convenience, any other portions of the speed reducing mechanism 115 except for the reduction gear 116 are not particularly shown in the drawings. The speed reducing mechanism 115 may include a known reduction gear.

The first spindle 120 includes a large-diameter portion 120*a* and a small-diameter portion 120*b* that is contiguous to the large-diameter portion 120*a*. The second spindle 130 has a hollow sleeve-like shape and is loosely fitted around the small-diameter portion 120*b* of the first spindle 120. As shown in FIG. 1, the small-diameter portion 120*b* of the first spindle 120 is inserted into the hollow portion of the second spindle 130. At this time, the outer circumferential surface of the large-diameter portion 120*a* of the first spindle 120 is flush with the outer circumferential surface of the second spindle 130. The second spindle 130 that is loosely fitted around the first spindle 120 is coaxial with the first spindle 120 and can rotate with respect to the first spindle 120.

A spring 160 that has a square cross section (hereinafter referred simply as "square spring 160) is weakly press-fitted and extends around the large-diameter portion 120*a* of the first spindle 120 and the second spindle 130. The square spring 160 comprises a winding having a square cross-section and is wound counterclockwise as viewed from the motor 113. An end 161 of the square spring 160 can move in the rotational direction of the first spindle 120, so that the square spring 160 is closely wound around the large-diameter portion 120*a* of the first spindle 120 and the second spindle 130. In other words, the winding portion of the square spring 160 make contact with the circumferential surfaces of the first and second spindle 120, 130, respectively.

The square spring 160 can be closely wound around the first spindle 120 when the end 161 of the square spring 160 is allowed to slightly move in the rotational direction of the first spindle 120. On the other hand, the square spring 160 cannot be closely wound around the first spindle 120 when the square spring 160 is locked so that the end 161 of the square spring 160 cannot move in the rotational direction of the first spindle 120. In the representative embodiment, normally, the square spring 160 is closely wound around the first spindle 120 when the motor 113 drivingly rotates the first spindle 120 in the forward direction or clockwise as viewed from the side of the motor 113.

The end 161 (the right end as viewed in the drawing) of the square spring 160 is attached to a stopper plate 163. The stopper plate 163 is fitted on the large-diameter portion 120*a* of the first spindle 120 and disposed adjacent to the reduction gear 116. The stopper plate 163 normally rotates together with the first spindle 120 by friction between the stopper plate 163 and the circumferential surface of the large-diameter portion 120*a* and the side surface of the reduction gear 116. However, when a stopper pin 146 locks the stopper plate 163 and prevents the stopper plate 163 from rotating together with the first spindle 120, the stopper plate 163 is allowed to rotate relatively with respect to the first spindle 120 and the reduction gear 116 via a bearing 165.

Clutch cam 140 is provided on the left end portion of the second spindle 130. A recess 132 is formed in the left end portion of the second spindle 130, and a steel ball 143 is disposed within the recess 132. The clutch cam 140 is allowed to move by the axial length of the recess 132 in the axial direction of the second spindle 130 when the steel ball 143 moves within the recess 132. Further, the clutch cam 140 rotates together with the second spindle 130 via the steel ball 143 that is held within the recess 132. The clutch cam 140 and the third spindle 150 have engagement teeth 141, 151, respectively. The teeth 141 and 151 are engaged with each other according to FIG. 1. Although it is not particularly shown within the drawings, the teeth 141, 151 have engagement surfaces that are inclined with respect to each other. In response to the torque transmission between the teeth 141 and 151, the teeth 141, 151 may completely engage with each other. Otherwise, one of the teeth 141 and the teeth 151 may slide relative to the other along the engagement surfaces, so that the clutch cam 140 and the third spindle 150 can move away from each other in the axial direction. In the state as shown in FIG. 1, the steel ball 143 moves to the left end of the recess 132 within the recess 132. Further, the clutch cam 140 is located near to the third spindle 150. In this state, the teeth 141 and 151 engage with each other. As a result, the second spindle 130 and the third spindle 150 rotate together. The recess 132 may extend obliquely with respect to the axial direction of the second spindle 130. In this case, the clutch cam 140 and the third spindle 150 can move relative to each other in the axial direction by the relative movement between the steel ball 143 and the recess 132. Therefore, the teeth 141, 151 are not necessarily required to have engagement surfaces that are inclined with respect to each other.

Clutch cam 140 is urged toward the third spindle 150 by the biasing force of the spring 171, so that the teeth 141 and 151 normally engage each other. The biasing force of the spring 171 that is exerted upon the clutch cam 140 can be changed by means of a spring biasing force adjusting device 172. Specifically, one end (the right end as viewed in FIG. 1) of the spring 171 is connected to the spring biasing force adjusting device 172. The spring biasing force adjusting device 172 includes a spring support washer 179, a torque adjusting sleeve 177, a torque adjusting pin 175 and a torque adjusting ring 173. When the user of the screwdriver turns the torque adjusting ring 173, the torque adjusting sleeve 177 moves in the axial direction via the torque adjusting pin 175. As a result, the amount of contraction of the spring 171 changes, and accordingly the biasing force of the spring 171 that is exerted upon the clutch cam 140 changes.

Further, a rod-like stopper pin 146 is coupled to the clutch cam 140. The stopper pin 146 extends in the axial direction of the first spindle 120 and the second spindle 130. The stopper pin 146 can rotate relative to the clutch cam 140. Further, when the clutch cam 140 moves in the axial direction of the second spindle 130, the stopper pin 146 moves in the axial direction together with the clutch cam 140. Specifically, when the clutch cam 140 rotates together with the second spindle 130, the rotational movement is not transmitted to the stopper pin 146, so that the stopper pin 146 is held in predetermined position. On the other hand, when the clutch cam 140 moves in the axial direction of the second spindle 130, the stopper pin 146 moves in the axial direction of the second spindle 130 together with the clutch cam 140. The axial length of the recess 132 of the second spindle 130 defines the distance of movement of the clutch cam 140 and the stopper pin 146 as well.

When the clutch cam 140 is urged toward the third spindle 150 by the biasing force of the spring 171, the stopper pin 146 is held apart from the stopper plate 163. However, when the screw-tightening torque exceeds a predetermined torque as will be described below in detail, the clutch cam 140 moves rightward as viewed in the drawing in the axial direction of the second spindle 130. As a result, the stopper pin 146 abuts against and engages with a gear-like stopper pin engagement portion 163*a* on the stopper plate 163. Thus, the stopper pin 146 engages and retains the stopper plate 163. At this stage, because the rotational movement of the clutch cam 140 is not transmitted to the stopper plate 163, the stopper plate 163 is prevented from rotating together with the first spindle 120.

As a result, the square spring 160 is prevented from rotating together with the rotating first spindle 120. Thus, the end 161 of the square spring 160 is prevented from slightly moving in the rotational direction of the first spindle 120. In this state, the square spring 160 can no longer be closely wound around the large-diameter portion 120*a* of the first spindle 120. The winding engagement of the square spring 160 on the first spindle 120 is thus released. As a result, the square spring 160 is loosened and the rotating torque of the motor 113 cannot be transmitted from the first spindle 120 to the second spindle 130, and therefore the first spindle 120 rotates idly.

Further, the left end (as viewed in the drawing) of the first spindle 120 is connected to the third spindle 150 via a one-way clutch 181. The one-way clutch 181 allows torque transmission from the second spindle 130 to the third spindle 150 when the motor 113 drives the first spindle 120 and thus the second spindle 130 in a forward direction (clockwise as viewed from the motor 113). On the other hand, the one-way clutch 181 directly transmits torque from the first spindle 120 to the third spindle 150 when the motor 113 is rotated in a reverse direction to rotate the first spindle 120 in the reverse direction (counterclockwise as viewed from the motor 113). The one-way clutch 181 as itself is a known structure and therefore its detailed description will be abbreviated.

Tool bit 123 is mounted to the end of the third spindle 150 via a tool bit mounting chuck 153. In use, a screw 124 to be tightened on a workpiece 125 is attached to the end of the tool bit 123.

The operation and usage of the screwdriver 100 according to the representative embodiment will now be explained. User of the screwdriver 100 attaches a screw 124 to the end of the tool bit 123 and makes the end of the screw 124 into contact with the workpiece 125. At this time, the user is not required to apply a heavy pressing load onto the screw 124. To the contrary, only a light abutment of the end of the screw 124 against the workpiece 125 is sufficient to conduct screw-tightening operation. In this state, the user throws a trigger switch on the hand grip (not particularly shown in the drawings) in order to drive the motor 113. When the motor 113 is driven, the first spindle 120 receives the rotating torque of the motor via an output shaft 113*a* and a speed reducing mechanism 115.

At this stage, the stopper plate 163 rotates together with the first spindle 120 by friction. Thus, the end 161 of the square spring 160 is allowed to rotate as the first spindle 120 rotates. When the large-diameter portion 120*a* of the first spindle 120 rotates in the forward direction (clockwise as viewed from the motor 113), the square spring 160 that is wound counterclockwise is closely wound around the large-diameter portion 120*a* of the first spindle 120 and then around the second spindle 130. As a result, the rotating torque of the motor 113 is transmitted from the first spindle 120 to the second spindle 130 via the square spring 160.

The square spring 160 transmits the rotation of the first spindle 120 to the second spindle 130 by its close winding around the large-diameter portion 120*a* of the first spindle 120 and the second spindle 130. Then, the clutch cam 140 rotates together with the second spindle 130, and the third spindle 150 receives the rotating torque by engagement between the teeth 141 of the clutch cam 140 and the teeth 151 of the third spindle 150. The rotation of the third spindle 150 is transmitted to the tool bit 123 and the screw 124. Thus, the screw 124 is driven into the workpiece 125.

Figure 2:
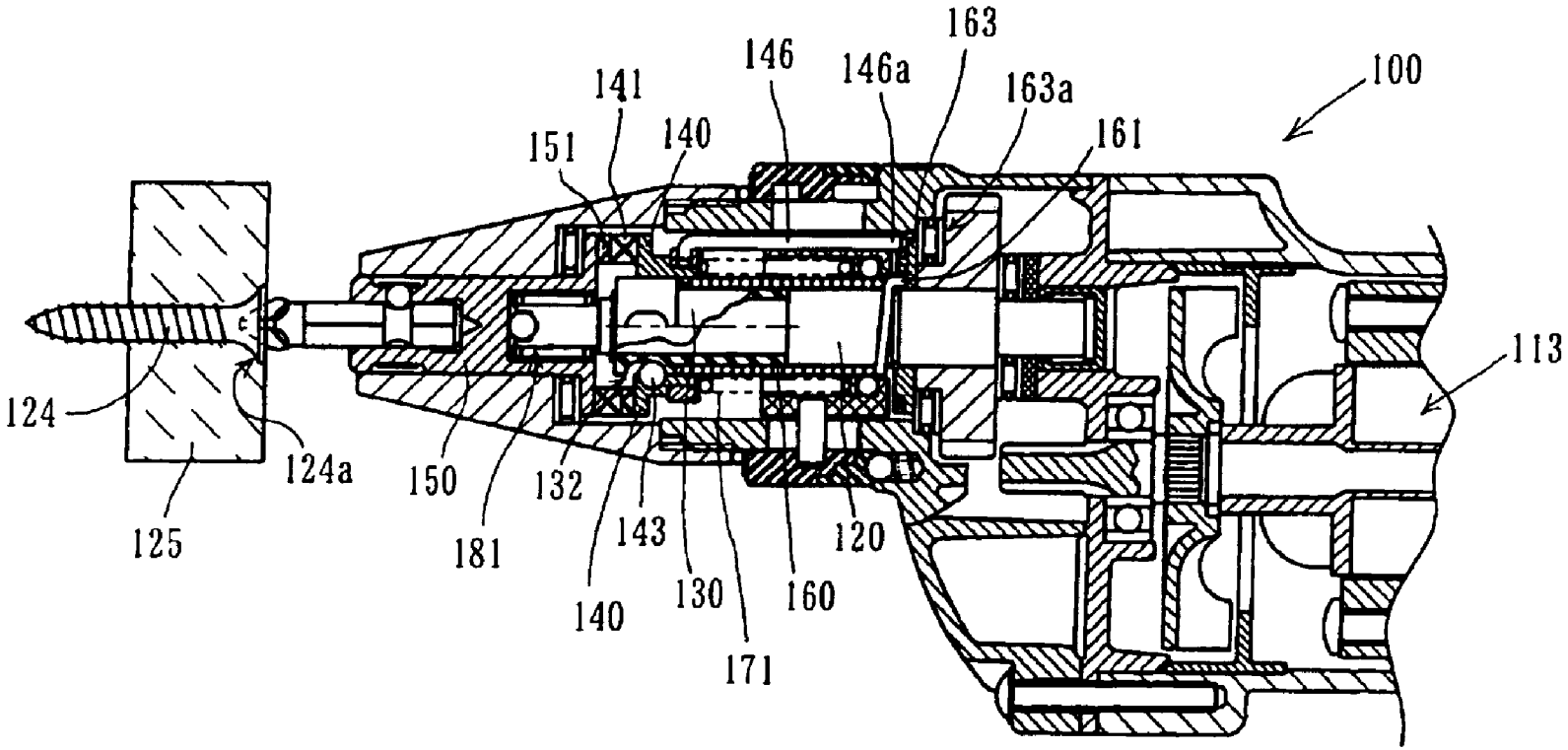
FIG. 2 shows the electric screwdriver in the state in which close winding of a torque transmission spring around a first spindle is released.

When the operation of tightening the screw 124 reaches a final stage and the head seat surface 124*a* of the screw 124 is seated on the workpiece 125, the screwdriver 100 further transmits the rotating torque of the motor 113 to the screw 124 that cannot be further tightened. As a result, as shown in FIG. 2, the teeth 141 of the clutch cam 140 comes to ride on the teeth 151 of the third spindle 150 opposing the biasing force of the spring 171. Thus, the clutch cam 140 moves toward the first spindle 120 (rightward as viewed in the drawing) in the axial direction of the second spindle 130. Then, the stopper pin 146, which is arranged to move together with the clutch cam 140 in the axial direction, moves. At this time, an end 146*a* of the stopper pin 146 engages with the stopper pin engagement portion 163*a* provided on the stopper plate 163.

Because the rotational movement of the clutch cam 140 (and the second spindle 130) is not transmitted to the stopper pin 146 as mentioned above, the stopper plate 163 is prevented from rotating together with the first spindle 120 when the stopper pin 146 engages with the stopper plate 163. In other words, when the first spindle 120 rotates, the stopper plate 163 in engagement with the stopper pin 146 is allowed to rotate relative to the first spindle 120 via the bearing 165.

As a result, the end 161 of the square spring 160 is prevented from moving in the rotational direction of the first spindle 120. In this state, the square spring 160 can no longer be closely wound around the large-diameter portion 120*a* of the first spindle 120. The winding engagement of the square spring 160 on the first spindle 120 is thus released. As a result, the rotating torque of the motor 113 is prevented from being transmitted from the first spindle 120 to the second spindle 130 and therefore, the first spindle 120 rotates idly without transmitting the rotating torque to the second spindle 130. Such torque transmission can be stopped instantaneously.

As mentioned above, in the screwdriver 100 according to the representative embodiment, simply by making the screw 124 in abutment on the workpiece 125 and operating the trigger switch to drive the motor 113, the square spring 160 is swiftly and closely wound around the first spindle 120 and the second spindle 130. Thus, the rotating torque of the motor 113 is promptly transmitted to the tool bit 123 and the screw 124.

When the operation of tightening the screw 124 is substantially completed and the screw-tightening torque exceeds a predetermined range, the teeth 141 of the clutch cam 140 comes to ride on the teeth 151 of the third spindle 150. Then, the clutch cam 140 moves in the axial direction and the stopper pin 146 engages with the stopper plate 163. As a result, the square spring 160 is prevented from being closely wound around the first spindle 120. The winding engagement of the square spring 160 on the first spindle 120 is thus released instantaneously, so that transmission of the rotating torque of the motor 113 promptly and assuredly stops.

According to the representative embodiment, the square spring 160 is used to transmit the rotating torque of the motor 113 from the first spindle 120 to the second spindle 130. In the transmission of the rotating torque of the motor 113 by means of the square spring 160, a torque transmission releasing device 145 can appropriately stop the torque transmission in response to the tightening torque. Therefore, it is not necessary for the user of the screwdriver to apply a strong pressing load onto the screwdriver as in the conventional technique in order to engage the rotating members with each other. Thus, the screw-tightening operation can be efficiently and easily performed.

Particularly as for a screw such as a universal joint, which is tightened in a relatively narrow work area, the user of the known screwdriver may be in difficulty to continuously apply a pressing load onto the screwdriver during the screw tightening operation. However, according to the present invention, it is not necessary to apply a strong pressing load onto the screwdriver in the screw-tightening direction in order to apply the rotating torque of the motor 113. As a result, torque transmission can be efficiently performed or stopped even in such case.

I claim:

1. A screwdriver, comprising:

a motor, a first rotating member that receives rotating torque of the motor, a second rotating member that is adapted to rotate by receiving the rotating torque of the first rotating member, a tool that performs a screw tightening operation by receiving the rotating torque via the first rotating member and the second rotating member, a torque transmission spring that is closely wound around the first rotating member and the second rotating member when the motor drivingly rotates the first rotating member in a predetermined rotating direction, so that the torque transmission spring transmits the rotating torque of the motor from the first rotating member to the second rotating member, a torque transmission releasing device that moves in the axial direction of the first rotating member or the second rotating member in response to the screw-tightening torque, so that the torque transmission releasing device releases the close winding of the torque transmission spring around at least one of the first rotating member and the second rotating member so as to release the transmission of the rotating torque of the motor from the first rotating member to the second rotating member, and a third rotating member that is disposed adjacent to the second rotating member and in the vicinity of the tool, the second rotating member being connected to the third rotating member via a clutch member, the clutch member being adapted to move toward the first rotating member in the axial direction in response to the screw-tightening torque, wherein the close winding of the torque transmission spring around the first rotating member is performed or released in response to the axial movement of the clutch member.

2. The screwdriver as defined in claim 1, wherein the torque transmission releasing device engages the torque transmission spring so as to prevent the torque transmission spring from being closely wound in the rotational direction of the first rotating member, so that the torque transmission releasing device releases the close winding of the torque transmission spring around the first rotating member.

3. The screwdriver as defined in claim 1, wherein the clutch member includes an engagement member that extends toward the first rotating member, the clutch member being urged away from the first rotating member by a spring, the clutch member being adapted and arranged to move toward the first rotating member so as to oppose to the biasing force of the spring when the screw-tightening torque exceeds a predetermined torque, such that the engagement member engages the torque transmission spring so as to release the close winding of the torque transmission spring around the first rotating member.

4. The screwdriver as defined in claim 1, further comprising a first torque transmission path and a second torque transmission path, wherein the rotating torque of the motor is transmitted from the first rotating member to the tool via the torque transmission spring and the second rotating member through the first torque transmission path, and when the motor is rotated in a reverse direction so that the torque transmission by the torque transmission spring is released, the torque of the motor rotating in the reverse direction is transmitted from the first rotating member to the tool via a one-way clutch through the second torque transmission path.

5. The screwdriver as defined in claim 1, wherein the rotating members are defined by spindles that rotatably extends to the longitudinal axis thereof, respectively.

6. The screwdriver as defined in claim 5, wherein each spindle rotates around the same longitudinal axis.

7. A method of using a screwdriver, wherein the screwdriver includes a motor, a first rotating member that receives rotating torque of the motor, a second rotating member that is adapted to rotate by receiving the rotating torque of the first rotating member, a tool that performs a screw tightening operation by receiving the rotating torque via the first rotating member and the second rotating member, a torque transmission spring that is closely wound around the first rotating member and the second rotating member when the motor drivingly rotates the first rotating member in a predetermined rotating direction, so that the torque transmission spring transmits the rotating torque of the motor from the first rotating member to the second rotating member, a torque transmission releasing device that moves in the axial direction of the first rotating member or the second rotating member, and a third rotating member that is disposed adjacent to the second rotating member and in the vicinity of the tool, the second rotating member being connected to the third rotating member via a clutch member, the clutch member being adapted to move toward the first rotating member in the axial direction in response to the screw-tightening torque, comprising:

releasing the close winding of the torque transmission spring around at least one of the first rotating member and the second rotating member by means of the movement of the torque transmission releasing device in the axial direction so as to release the transmission of the rotating torque of the motor from the first rotating member to the second rotating member in response to the screw-tightening torque, wherein the close winding of the torque transmission spring around the first rotating member is performed or released in response to the axial movement of the clutch member.

8. A screwdriver, comprising:

a motor, a first rotating member that receives rotating torque of the motor, a second rotating member that is adapted to rotate by receiving the rotating torque of the first rotating member, a tool that performs a screw tightening operation by receiving the rotating torque via the first rotating member and the second rotating member, a torque transmission spring that is closely wound around the first rotating member and the second rotating member when the motor drivingly rotates the first rotating member in a predetermined rotating direction, so that the torque transmission spring transmits the rotating torque of the motor from the first rotating member to the second rotating member, means for releasing the torque transmission by releasing the close winding of the torque transmission spring around at least one of the first rotating member and the second rotating member by means of a movement in the axial direction of the first rotating member or the second rotating member in response to the screw-tightening torque, so as to release the transmission of the rotating torque of the motor from the first rotating member to the second rotating member, and a third rotating member that is disposed adjacent to the second rotating member and in the vicinity of the tool, the second rotating member being connected to the third rotating member via a clutch member, the clutch member being adapted to move toward the first rotating member in the axial direction in response to the screw-tightening torque, wherein the close winding of the torque transmission spring around the first rotating member is performed or released in response to the axial movement of the clutch member.

9. The screwdriver as defined in claim 8, wherein the torque transmission releasing means engages the torque transmission spring so as to prevent the torque transmission spring from being closely wound in the rotational direction of the first rotating member, so that the torque transmission releasing means releases the close winding of the torque transmission spring around the first rotating member.

10. The screwdriver as defined in claim 8, wherein the clutch member includes engagement means that extends toward the first rotating member, the clutch means being urged away from the first rotating member by a spring, the clutch member being adapted and arranged to move toward the first rotating member so as to oppose to the biasing force of the spring when the screw-tightening torque exceeds a predetermined torque, such that the engagement member engages the torque transmission spring so as to release the close winding of the torque transmission spring around the first rotating member.

11. The screwdriver as defined in claim 8, further comprising a first torque transmission path and a second torque transmission path, wherein the rotating torque of the motor is transmitted from the first rotating member to the tool via the torque transmission spring and the second rotating member through the first torque transmission path, and when the motor is rotated in a reverse direction so that the torque transmission by the torque transmission spring is released, the torque of the motor rotating in the reverse direction is transmitted from the first rotating member to the tool via a one-way clutch through the second torque transmission path.

12. A screwdriver, comprising:

a motor, a first spindle that rotates together with the motor and receives a rotating torque of the motor, a second spindle that is adapted to rotate around the same longitudinal axis as the first spindle by receiving the rotating torque of the first spindle, a driver bit that performs a screw tightening operation by receiving the rotating torque via the first spindle and the second spindle, a torque transmission spring that is closely wound around the first spindle and the second spindle when the motor drivingly rotates the first spindle in a predetermined rotating direction, so that the torque transmission spring transmits the rotating torque of the motor from the first spindle to the second spindle, and a torque transmission releasing device that moves in the axial direction of the first spindle or the second spindle in response to the screw-tightening torque, wherein the torque transmission device engages with the torque transmission spring so as to prevent the torque transmission spring from being closely wound in the rotational direction of the first spindle, so that the torque transmission releasing device releases the close winding of the torque transmission spring around at least one of the first spindle and the second spindle to release the transmission of the rotating torque of the motor from the first spindle to the second spindle.

13. A screwdriver, comprising:

a motor, a first spindle that rotates together with the motor and receives a rotating torque of the motor, a second spindle that is adapted to rotate by receiving the rotating torque of the first spindle, a driver bit that performs a screw tightening operation by receiving the rotating torque via the first spindle and the second spindle, a torque transmission spring that is closely wound around the first spindle and the second spindle when the motor drivingly rotates the first spindle in a predetermined rotating direction, so that the torque transmission spring transmits the rotating torque of the motor from the first spindle to the second spindle, a third spindle that is disposed adjacent to the second spindle and in the vicinity of the tool, and a clutch member that connects the second spindle to the third spindle, the clutch member being adapted to move toward the first spindle in the axial direction in response to the screw-tightening torque, wherein the close winding of the torque transmission spring around the first spindle is performed or released in response to the axial movement of the clutch member.

14. A screwdriver, comprising:

a motor, a first spindle that rotates together with the motor and receives a rotating torque of the motor, a second spindle that is adapted to rotate by receiving the rotating torque of the first spindle, a driver bit that performs a screw tightening operation by receiving the rotating torque via the first spindle and the second spindle, a torque transmission spring that is closely wound around the first spindle and the second spindle when the motor drivingly rotates the first spindle in a predetermined rotating direction, so that the torque transmission spring transmits the rotating torque of the motor from the first spindle to the second spindle, a third spindle that is disposed adjacent to the second spindle and in the vicinity of the tool, and a clutch member that connects the second spindle to the third spindle, wherein the clutch member includes an engagement member that extends toward the first spindle, the clutch member being urged away from the first spindle by a spring, the clutch member being adapted and arranged to move toward the first spindle so as to oppose to the biasing force of the spring when the screw-tightening torque exceeds a predetermined torque, such that the engagement member engages the torque transmission spring so as to release the close winding of the torque transmission spring around the first spindle.

15. A screwdriver, comprising:

a motor, a first spindle that rotates together with the motor and receives a rotating torque of the motor, a second spindle that is adapted to rotate by receiving the rotating torque of the first spindle, a driver bit that performs a screw tightening operation by receiving the rotating torque via the first spindle and the second spindle, a torque transmission spring that is closely wound around the first spindle and the second spindle when the motor drivingly rotates the first spindle in a predetermined rotating direction, so that the torque transmission spring transmits the rotating torque of the motor from the first spindle to the second spindle, a torque transmission releasing device that moves in the axial direction of the first spindle or the second spindle in response to the screw-tightening torque, wherein the torque transmission device engages with the torque transmission spring so as to prevent the torque transmission spring from being closely wound in the rotational direction of the first spindle, so that the torque transmission releasing device releases the close winding of the torque transmission spring around at least one of the first spindle and the second spindle to release the transmission of the rotating torque of the motor from the first spindle to the second spindle, and a first torque transmission path and a second torque transmission path, wherein the rotating torque of the motor is transmitted from the first spindle to the tool via the torque transmission spring and the second spindle through the first torque transmission path, and when the motor is rotated in a reverse direction so that the torque transmission by the torque transmission spring is released, the torque of the motor rotating in the reverse direction is transmitted from the first spindle to the tool via a one-way clutch through the second torque transmission path.

* * * * *